US009589507B2

(12) United States Patent
Feng

(10) Patent No.: US 9,589,507 B2
(45) Date of Patent: Mar. 7, 2017

(54) DRIVING CIRCUIT FOR ACTIVE MATRIX ORGANIC LIGHT-EMITTING DIODE

(71) Applicant: EverDisplay Optronics (Shanghai) Limited, Shanghai (CN)

(72) Inventor: Yu-Hsiung Feng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 42 days.

(21) Appl. No.: 14/678,221

(22) Filed: Apr. 3, 2015

(65) Prior Publication Data

US 2015/0302799 A1 Oct. 22, 2015

(30) Foreign Application Priority Data

Apr. 22, 2014 (CN) ..... 2014 1 0162958

(51) Int. Cl.
*G09G 3/32* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2320/0219* (2013.01)

(58) Field of Classification Search
CPC ..... G09G 3/3225
See application file for complete search history.

(56) References Cited

U.S. PATENT DOCUMENTS

2002/0021096 A1 2/2002 Komiya
2012/0223876 A1* 9/2012 Kitazawa ..... G09G 3/3258 345/84

FOREIGN PATENT DOCUMENTS

| | | | |
|---|---|---|---|
| CN | 1333524 | A | 1/2002 |
| CN | 1547183 | A | 11/2004 |
| CN | 101075410 | A | 11/2007 |
| CN | 101620353 | A | 1/2010 |
| CN | 103117042 | A | 5/2013 |
| TW | 1304565 | B | 12/2008 |
| TW | 1353573 | B | 12/2011 |
| TW | 201541447 | A | 11/2015 |
| TW | 200539076 | A | 12/2015 |

OTHER PUBLICATIONS

Office Action issued Dec. 2, 2015 by the TW Office.
Office Action issued Sep. 1, 2015 by the TW Office.

* cited by examiner

*Primary Examiner* — Michael Faragalla
*Assistant Examiner* — Chayce Bibbee
(74) *Attorney, Agent, or Firm* — Yunling Ren

(57) ABSTRACT

The disclosure discloses a driving circuit for AMOLED consisting essentially of a scanning line for providing a scanning voltage; a reverse scanning line for providing a reverse scanning voltage reverse to the scanning voltage; a data line for providing a data voltage; a storage capacitor; and a CMOS transmission gate having two control terminals, an input terminal and an output terminal. The two control terminals are respectively electrically coupled to the scanning line and the reverse scanning line. The input terminal is electrically coupled to the data line. The output terminal is electrically coupled to the storage capacitor. The CMOS transmission gate is configured to couple the data voltage to the storage capacitor via control of the scanning voltage and the reverse scanning voltage.

7 Claims, 4 Drawing Sheets

DRIVING CIRCUIT FOR ACTIVE MATRIX ORGANIC LIGHT-EMITTING DIODE

CROSS-REFERENCE TO RELATED APPLICATIONS

This application claims benefits of Chinese Patent Application No. 201410162958.0, filed on Apr. 22, 2014 in the State Intellectual Property Office of China, the disclosure of which is incorporated herein by reference in its entirety.

TECHNICAL FIELD

The present disclosure relates in general to a driving circuit for a light-emitting diode (OLED) and, in particular, to a driving circuit for an active matrix organic light-emitting diode (AMOLED).

BACKGROUND ART

The active matrix organic light-emitting diode (AMOLED) display is a new type display. In the conventional pixel driving circuit for the AMOLED, the driving architecture is generally designed similar to the conventional liquid crystal display (LCD). Pixel data are updated in column in time-sharing mode, and the mainstream of pixel driving mode is voltage compensation, and a gate voltage feedthrough effect may still be generated in the circuit architecture.

FIG. 1 is a schematic circuit diagram showing a driving circuit for an AMOLED. As shown in FIG. 1, the drain of an NMOS transistor M16 is electrically coupled to the data voltage Vdata, the gate is electrically coupled to the scanning voltage Scan, the source is electrically coupled to the terminal Vc1 of the storage capacitor Cst. The drain of the NMOS transistor M14 is electrically coupled to the terminal Vc1 of the storage capacitor Cst and the source of the NMOS transistor M16. The gate of the NMOS transistor M14 is electrically coupled to the discharge voltage Discharge, the source of the NMOS transistor M14 is electrically coupled to the terminal Vc2 of the storage capacitor Cst. The drain of the NMOS transistor M13 is electrically coupled to the source of the NMOS transistor M14 and the terminal Vc2 of the storage capacitor Cst, the gate of the NMOS transistor M13 is electrically coupled to the scanning voltage Scan. The drain of the PMOS transistor M11 is electrically coupled to the power voltage Vdd, and the gate of the PMOS transistor M11 is electrically coupled to the terminal Vc2 of the storage capacitor Cst, the source of the NMOS transistor M14 and the drain of the NMOS transistor M13. The source of the PMOS transistor M11 is electrically coupled to the source of the NMOS transistor M13. The drain of the PMOS transistor M12 is electrically coupled to the source of the PMOS transistor M11 and the source of the NMOS transistor M13. The gate of the PMOS transistor M12 is electrically coupled to the emitting control signal Emit, the source of the PMOS transistor M12 is electrically coupled to the OLED EL. The drain of the PMOS transistor M15 is electrically coupled to the reference voltage Vref, the gate of the PMOS transistor M15 is electrically coupled to the scanning voltage Scan, the source of the PMOS transistor M15 is electrically coupled to the terminal Vc1 of the storage capacitor Cst, the source of the NMOS transistor M16 and the drain of the NMOS transistor M14.

In the pixel driving circuit of FIG. 1, the NMOS transistor M16 is mainly used to write the data voltage Vdata at the data line to the pixel terminal Vc1. When Vscan is switched to low voltage level, voltage written to terminal Vc1 is decreased by 0.5~1 Volts due to the feedthrough effect generated when turning off the transistor M16. In practical application, the feedthrough voltage changes with different written data voltages Vdata. In the pixel driving circuit of the AMOLED display, the written data voltage Vdata needs to convert to current for the OLED via the PMOS transistor M11 after compensation, since current driving is adopted in OLED to control the gray scales. The PMOS transistor M11 stays in saturation region when driving the OLED, as the result, the driving current for the OLED is affected by the actual input data voltage Vdata, which causes driving current difference for the OLED and thus causes color difference.

The above information disclosed in this Background section is only for enhancement of understanding of the background of the disclosure and therefore it may contain information that does not form the prior art that is already known in this country to the person of ordinary skill in the art.

SUMMARY OF INVENTION

Additional aspects and advantages will be set forth in part in the description which follows and, in part, will be apparent from the description, or may be learned by practice of the disclosure.

According to one aspect of the disclosure, a driving circuit for an active matrix organic light-emitting diode (AMOLED), comprising: a scanning line for providing a scanning voltage; a reverse scanning line for providing a reverse scanning voltage reverse to the scanning voltage; a data line for providing a data voltage; a storage capacitor; and a CMOS transmission gate having two control terminals, a input terminal and an output terminal, the two control terminals respectively electrically coupled to the scanning line and the reverse scanning line, the input terminal electrically coupled to the data line, the output terminal electrically coupled to the storage capacitor, the CMOS transmission gate configured to couple the data voltage from the data line to the storage capacitor via the control of the scanning voltage and the reverse scanning voltage.

According to an embodiment, the driving circuit further comprises a first transistor having a control terminal, a first terminal and a second terminal which are respectively electrically coupled to the storage capacitor, a power voltage and an OLED, for driving the OLED via a voltage stored in the storage capacitor.

According to an embodiment, the driving circuit further comprises a second transistor, a third transistor and a fourth transistor respectively having a control terminal, a first terminal and a second terminal, wherein the first terminal of the second transistor is electrically coupled to the second terminal of the first transistor and the second terminal of the third transistor, the control terminal of the second transistor is electrically coupled to an emitting control signal, the second terminal is electrically coupled to the OLED; the first terminal of the third transistor is electrically coupled to the second terminal of the fourth transistor and the second terminal of the storage capacitor, the control terminal of the third transistor is electrically coupled to the scanning line; the first terminal of the fourth transistor is electrically coupled to the first terminal of the storage capacitor and the output terminal of the CMOS transmission gate, the control terminal of the fourth CMOS transistor is electrically coupled to a discharge signal.

According to an embodiment, the driving circuit further comprises a fifth transistor having a control terminal, a first terminal and a second terminal, wherein the first terminal of the fifth transistor is electrically coupled to a reference voltage, the control terminal of the fifth transistor is electrically coupled to the scanning line, and the second terminal of the fifth transistor is electrically coupled to the first terminal of the storage capacitor.

According to an embodiment, the first transistor, the second transistor and the fifth transistor are PMOS transistors, the third transistor and the fourth transistor are NMOS transistors.

According to an embodiment, an anode of the OLED is electrically coupled to the second terminal of the second transistor.

According to an embodiment, the CMOS transmission gate comprises a PMOS transistor and a NMOS transistor, drains of the PMOS transistor and the NMOS transistor are electrically coupled to the data line, sources of the PMOS transistor and the NMOS transistor are electrically coupled to the first terminal of the storage capacitor, a gate of the NMOS transistor is electrically coupled to the scanning line, and a gate of the PMOS transistor is electrically coupled to the reverse scanning line.

According to an embodiment, the driving circuit further comprises an inverter, wherein the scanning voltage is input to the inverter to generate the reverse scanning voltage.

According to an embodiment, the control terminal is the gate terminal, the first terminal is the drain terminal and the second terminal is the source terminal.

BRIEF DESCRIPTION OF THE DRAWINGS

The foregoing and other features and advantages of the disclosure will be apparent to those skilled in the art in view of the following detailed description, taken in conjunction with the accompanying drawings.

DETAILED DESCRIPTION

Figure 1:
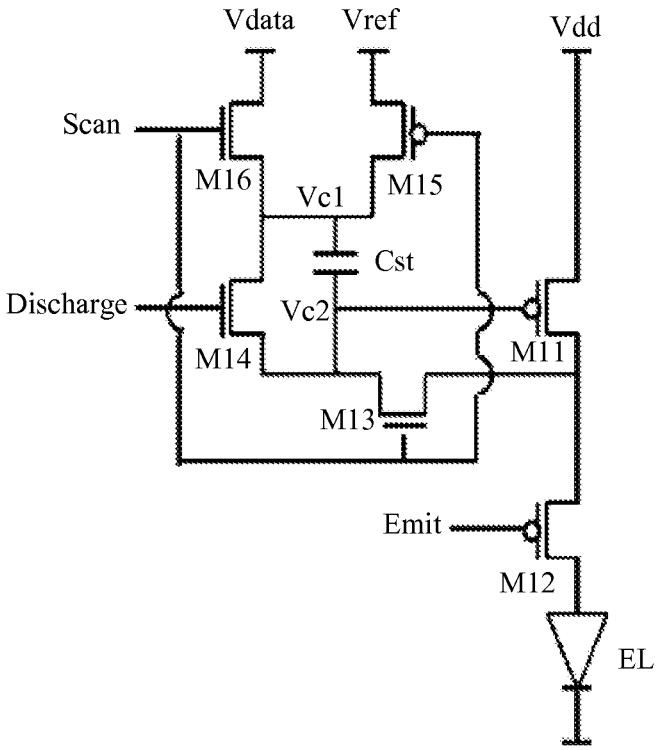
FIG. 1 illustrates a schematic circuit diagram showing a conventional driving circuit for AMOLED.

Exemplary embodiments of the disclosure will now be described more fully with reference to the accompanying drawings, in which exemplary embodiments are shown. Exemplary embodiments of the disclosure may, however, be embodied in many different forms and should not be construed as being limited to the embodiments set forth herein; rather, these embodiments are provided so that this disclosure will be thorough and complete, and will fully convey the concept of exemplary embodiments to those skilled in the art. In the drawings, the thicknesses of layers and regions are exaggerated for clarity. Like reference numerals in the drawings denote like elements, and thus their description will be omitted.

The described features, structures, or/and characteristics of the disclosure may be combined in any suitable manner in one or more embodiments. In the following description, numerous specific details are disclosed to provide the thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

It will be understood that when an element or layer is referred to as being on, connected to, or coupled to another element or layer, it can be directly on, connected or coupled to the other element or layer or intervening elements or layers may be present. In contrast, when an element is referred to as being directly on, directly connected to, or directly coupled to another element or layer, there are no intervening elements or layers present. Like numbers refer to like elements throughout. As used herein, the term and/or includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Figure 2:
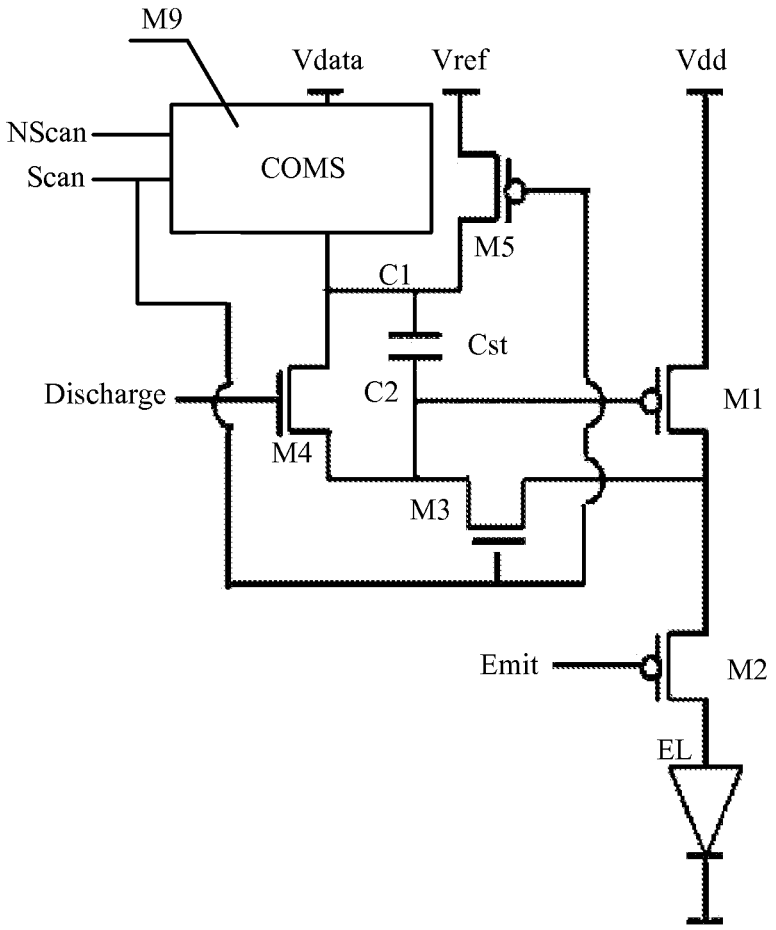
FIG. 2 illustrates a schematic circuit diagram of the driving circuit for AMOLED according to an embodiment of the disclosure.

FIG. 2 illustrates a schematic circuit diagram of the driving circuit for the AMOLED according to an embodiment of the disclosure. As shown in FIG. 2, the driving circuit for the AMOLED according to an embodiment includes the CMOS transmission gate M9, the PMOS transistor M1, the PMOS transistor M2, the NMOS transistor M3, the NMOS transistor M4 and the storage capacitor Cst.

As shown in FIG. 2, the control terminal of the CMOS transmission gate M9 is electrically coupled to the scanning voltage Scan through the scanning line and the reverse scanning voltage Nscan through the reverse scanning line. The input terminal of the CMOS transmission gate M9 is electrically coupled to the data voltage Vdata. The output terminal of the CMOS transmission gate M9 is electrically coupled to the terminal C1 of the storage capacitor Cst. The drain of the NMOS transistor M4 is electrically coupled to the terminal C1 of the storage capacitor Cst and the output terminal of the CMOS transmission gate M9, the gate of the NMOS transistor M4 is electrically coupled to the discharge voltage Discharge, and the source is electrically coupled to the terminal C2 of the storage capacitor Cst. The drain of the NMOS transistor M3 is electrically coupled to the source of the NMOS transistor M4 and another terminal of the storage capacitor Cst, the gate of the NMOS transistor M3 is electrically coupled to the scanning voltage Scan. The drain of the PMOS transistor M1 is electrically coupled to the power voltage Vdd. The gate of the PMOS transistor M1 is electrically coupled to the terminal C2 of the storage capacitor Cst, the source of the NMOS transistor M4 and the drain of the NMOS transistor M3. The source of the PMOS transistor M1 is electrically coupled to the source of the NMOS transistor M3. The drain of the PMOS transistor M2 is electrically coupled to the source of the PMOS transistor M1 and the source of the NMOS transistor M3. The gate of the PMOS transistor M2 is electrically coupled to emitting control signal Emit. The source of the PMOS transistor M2 is electrically coupled to the light-emitting element EL.

In another embodiment, as shown in FIG. 2, the driving circuit further includes a PMOS transistor M5. The drain of the PMOS transistor M5 is electrically coupled to the reference voltage Vref. The gate of the PMOS transistor M5 is electrically coupled to the scanning voltage Scan. The source of the PMOS transistor M5 is electrically coupled to the terminal C1 of the storage capacitor Cst, the output terminal of the CMOS transmission gate M9 and the drain of the NMOS transistor M4. The reference voltage Vref is the reset voltage before data voltage Vdata is updated, thereby greatly increasing charge speed.

According to the embodiment, the CMOS transmission gate is used to replace the NMOS switching transistor. The threshold voltage of the NMOS and the threshold voltage of PMOS are adjusted properly to make the pull-up level equal to the pull-down level, thereby reducing the affection of the feedthrough effect and improving image quality.

Although the embodiment is described with reference to FIG. 2, the invention is not limited thereto. The skilled person in the art may know that, the conception of the invention may also be applied to other types of driving circuits for the light-emitting diode. Another driving circuit according to the embodiment is described hereinbelow.

Figure 3:
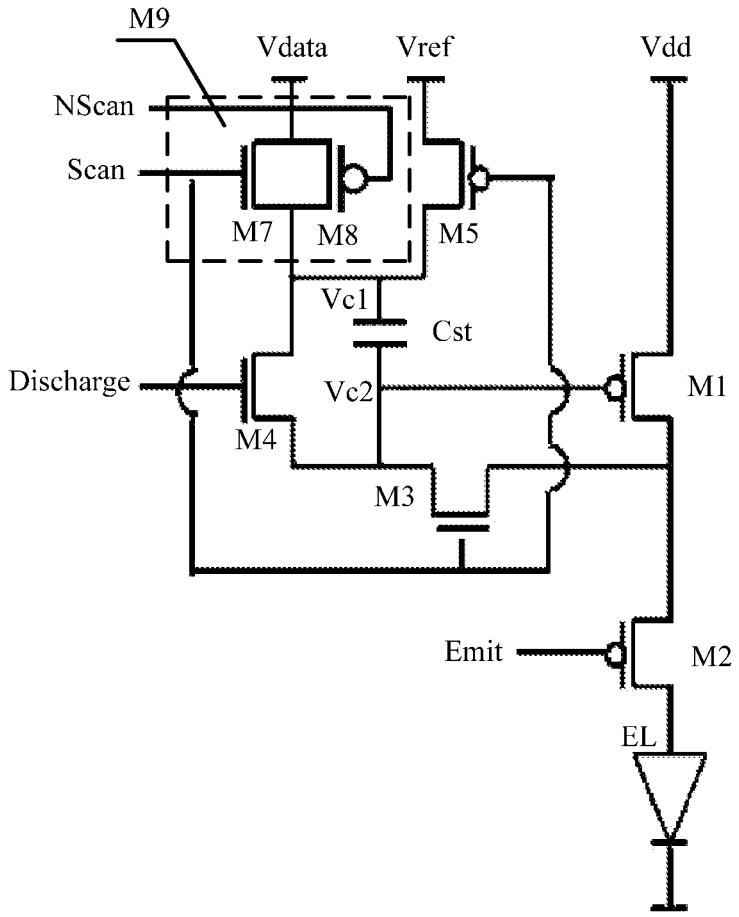
FIG. 3 illustrates a schematic circuit diagram of the driving circuit for AMOLED according to another embodiment of the disclosure.

FIG. 3 illustrates another schematic circuit diagram of the driving circuit for the AMOLED according to an embodiment of the disclosure. As shown in FIG. 3, the CMOS transmission gate M9 includes the PMOS transistor M8 and the NMOS transistor M7. The drain of the NMOS transistor M7 is electrically coupled to the data voltage Vdata. The source of the NMOS transistor M7 is electrically coupled to the terminal C1 of the storage capacitor Cst and the drain of the NMOS transistor M4. The gate of the NMOS transistor M7 is electrically coupled to the scanning voltage Scan. The drain of the PMOS transistor M8 is electrically coupled to the data voltage Vdata. The source of the PMOS transistor M8 is electrically coupled to the terminal C1 of the storage capacitor Cst and the drain of the NMOS transistor M4. The gate of the PMOS transistor M8 is electrically coupled to the reverse voltage NScan of the scanning voltage Scan.

The reverse voltage NScan may be obtained by an inverter (not shown) to which the scanning voltage Scan is input. The output of the inverter is electrically coupled to the gate of the PMOS transistor M8.

In the above embodiment, the light-emitting element EL may be the OLED EL whose anode is electrically coupled to the source of the PMOS transistor M2, and the cathode is conducted to the ground or Vss.

Figure 4:
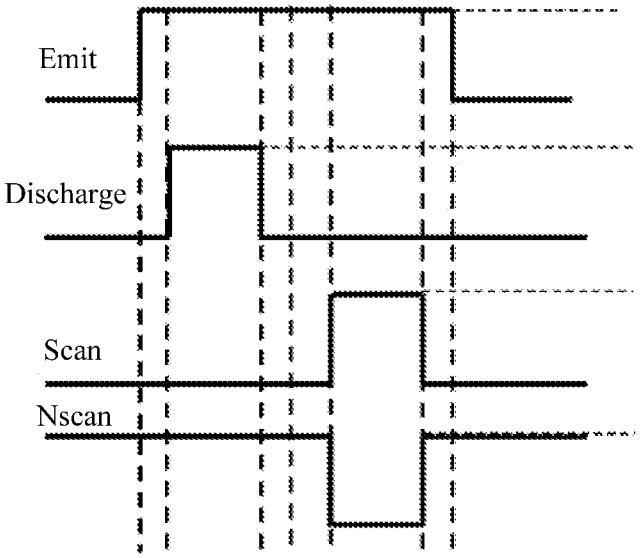
FIG. 4 illustrates the signal timing schematic of the driving circuit for AMOLED according to an embodiment of the disclosure.

FIG. 4 illustrates the signal timing schematic diagram of the driving circuit for the AMOLED according to an embodiment of the disclosure. The practical application process of the disclosure is illustrated hereinbelow with reference to FIG. 2 to FIG. 4.

In the whole pixel charging period, the emitting control signal Emit is in the high level, which makes the PMOS transistor M2 stay in off state. As the discharge voltage Discharge is in the high level, the storage capacitor Cst is discharged through the NMOS transistor M4 if it has remaining voltage charge. After the discharge voltage Discharge restores to the low level voltage, the scanning voltage Scan is in high level, and thus the reverse voltage NScan is in low level such that the CMOS transmission gate M9 is turned on. The data voltage Vdata charges the storage capacitor Cst via the CMOS transmission gate M9. After the charging process is finished, the scanning voltage Scan restores to the low level voltage. After the charging process is finished, the emitting control signal Emit turns to the low level voltage, at which time the PMOS transistor M1 is connected to the low voltage terminal of the storage capacitor Cst, therefore the PMOS transistor M1 is turned on. The PMOS transistor M2 is turned on, as the emitting control signal Emit turns to low level voltage. As a result, the light-emitting diode EL emits light.

According to the disclosure, the CMOS transmission gate is used to replace the NMOS transistor connected to the data voltage Vdata. Through the feedthrough voltage compensation characteristic of the CMOS transmission gate, that is, the feedthrough voltages generated when turning off the NMOS and PMOS are opposite, the color difference caused by driving current difference due to the feedthrough voltage difference may be reduced.

Exemplary embodiments have been specifically shown and described as above. It will be appreciated by those skilled in the art that the disclosure is not limited the disclosed embodiments; rather, all suitable modifications and equivalent which come within the spirit and scope of the appended claims are intended to fall within the scope of the disclosure.

What is claimed is:

1. A driving circuit for an active matrix organic light-emitting diode (AMOLED), consisting essentially of:

a scanning line for providing a scanning voltage;

a reverse scanning line for providing a reverse scanning voltage reverse to the scanning voltage;

a data line for providing a data voltage;

a storage capacitor;

a CMOS transmission gate having two control terminals, an input terminal and an output terminal, the two control terminals respectively electrically coupled to the scanning line and the reverse scanning line, the input terminal electrically coupled to the data line, the output terminal electrically coupled to the storage capacitor, the CMOS transmission gate configured to couple the data voltage to the storage capacitor via control of the scanning voltage and the reverse scanning voltage;

a first transistor having a control terminal, a first terminal and a second terminal which are respectively electrically coupled to the storage capacitor, a power voltage and an OLED; and a second transistor, a third transistor and a fourth transistor respectively having a control terminal, a first terminal and a second terminal, wherein the first terminal of the second transistor is electrically coupled to the second terminal of the first transistor, the control terminal of the second transistor is electrically coupled to an emitting control signal, the second terminal of the second transistor is electrically coupled to the OLED;

the first terminal of the third transistor is electrically coupled to a second terminal of the storage capacitor, the control terminal of the third transistor is electrically coupled to the scanning line, the second terminal of the third transistor is electrically coupled to the first terminal of the second transistor; and the first terminal of the fourth transistor is electrically coupled to a first terminal of the storage capacitor and the output terminal of the CMOS transmission gate, the control terminal of the fourth CMOS transistor is electrically coupled to a discharge signal, the second terminal of the fourth transistor is electrically coupled to the first terminal of the third transistor.

2. The driving circuit according to claim 1, further comprising a fifth transistor having a control terminal, a first terminal and a second terminal, wherein the first terminal of the fifth transistor is electrically coupled to a reference voltage, the control terminal of the fifth transistor is electrically coupled to the scanning line, and the second terminal of the fifth transistor is electrically coupled to the first terminal of the storage capacitor.

3. The driving circuit according to claim 2, wherein the first transistor, the second transistor and the fifth transistor are PMOS transistors, the third transistor and the fourth transistor are NMOS transistors.

4. The driving circuit according to claim 1, wherein an anode of the OLED is electrically coupled to the second terminal of the second transistor.

5. The driving circuit according to claim 1, wherein, the CMOS transmission gate comprises a PMOS transistor and a NMOS transistor, drains of the PMOS transistor and the NMOS transistor are electrically coupled to the data line, sources of the PMOS transistor and the NMOS transistor are electrically coupled to the first terminal of the storage capacitor, a gate of the NMOS transistor is electrically coupled to the scanning line, and a gate of the PMOS transistor is electrically coupled to the reverse scanning line.

6. The driving circuit according to claim 5, further comprising an inverter, wherein the scanning voltage is input to the inverter to generate the reverse scanning voltage.

7. The driving circuit according to claim 3, wherein the control terminal of each of the first to fifth transistors is a gate terminal, the first terminal of each of the first to fifth transistors is a drain terminal and the second terminal of each of the first to fifth transistors is a source terminal.

* * * * *